US006012597A

United States Patent [19]

Nishihara et al.

[11] Patent Number: 6,012,597

[45] Date of Patent: Jan. 11, 2000

[54] POLYESTER BOTTLE WITH A HANDLE AND METHOD OF MANUFACTURING THE SAME

[75] Inventors: Shunichi Nishihara; Masatoshi Ogishita, both of Kanagawa, Japan

[73] Assignee: Mitsubishi Plastics, Inc., Tokyo, Japan

[21] Appl. No.: 09/040,283

[22] Filed: Mar. 18, 1998

[51] Int. Cl.[7] ..... B65D 23/10

[52] U.S. Cl. ..... 215/398

[58] Field of Search ..... 215/396, 398

[56] References Cited

U.S. PATENT DOCUMENTS

| | | | |
|---|---|---|---|
| 4,398,642 | 8/1983 | Okudaira et al. | 215/12.2 |
| 4,913,945 | 4/1990 | Marahashi et al. | 215/370 |
| 4,964,522 | 10/1990 | Umetsu et al. | 215/398 |
| 5,250,335 | 10/1993 | Maruhashi et al. | 428/36.92 |
| 5,278,694 | 1/1994 | Wheatley et al. | 359/359 |
| 5,469,612 | 11/1995 | Collette et al. | 215/396 |
| 5,535,901 | 7/1996 | Ishii et al. | 215/398 |
| 5,560,506 | 10/1996 | Yanagisawa et al. | 215/398 |
| 5,637,167 | 6/1997 | Krishnakumar et al. | 215/396 |
| 5,739,959 | 4/1998 | Quaglia | 359/666 |
| 5,819,966 | 10/1998 | Ota et al. | 215/398 |
| 5,831,743 | 11/1998 | Ramos et al. | 356/445 |

FOREIGN PATENT DOCUMENTS 4-53695 8/1992 Japan .

6-134798 5/1994 Japan .

*Primary Examiner*—Stephen P. Garbe

*Attorney, Agent, or Firm*—Armstrong, Westerman, Hattori, McLeland & Naughton

[57] ABSTRACT

The present invention relates to polyester bottle with a handle comprising a polyester bottle body and a synthetic resin handle body mounted to said bottle body, and the method of manufacturing the same. Said bottle body comprises a neck portion, a shoulder portion continuous from said neck portion, a body portion continuous from said shoulder portion, a bottom portion continuous from said body portion and a handle mounting portion on the wall surface of said body portion formed by blowing air into a preform which is set to a cavity of a mold for biaxial stretch blow molding. Said handle body comprises a grip portion and a fixing portion continuous from said grip portion. Said fixing portion is connected to said handle mounting portion for mounting said handle body to said bottle body. Heat treatment is performed to at least said handle connecting portion of said handle mounting portion by heated air being blown into said bottle body. Said handle body could either be molded separately in advance, or molded after the blow molding of said bottle body by injection molding. Said heat treatment will be performed either after or simultaneously with the blow molding of said bottle body.

7 Claims, 4 Drawing Sheets

POLYESTER BOTTLE WITH A HANDLE AND METHOD OF MANUFACTURING THE SAME

BACKGROUND OF THE INVENTION AND RELATED ART STATEMENT

The present invention relates to a polyester bottle having a handle mounting portion of the bottle body being fixed by heat (heat treatment) which has advantageous heat resistance, and the method of manufacturing such bottle.

Plastic bottles have widely been used as bottles for a variety of liquids as they are light in weight and have high shock resistance characters. Particularly, bottles molded by biaxially blow stretching a thermoplastic polyester such as a polyethylene terephthalate not only has good transparency and surface gloss, but are also equipped with the shock resistance, the strength, the gas barrier characters all needed in a bottle, so it is widely used as bottles for liquids such as juice, soft drinks, carbonated beverages and the like.

However, the polyester bottle has a problem in that it has low heat resistance, and when heat-filling the contents, the bottles were likely to be deformed at times by heat, or the capacity may be changed by shrinking. Therefore, there was a need to mold the bottle body by a biaxial stretch blow, and then to perform a heat fix (heat treatment) in order to increase the heat resistance. As a method for such heat treatment, many suggestions were made in the prior art, and a known method, for example, increases the heat resistance by providing heat treatment to the bottle in a mold for blow molding heated to a high temperature.

The heat treatment inside the mold heated to a high temperature is industrially advantageous since there are only a small number of steps to be carried out, and the cost of the device is low. However, for the heat treatment after the blow molding and the following cooling step, it is necessary to take a long residence time inside the mold, which leads to a longer molding cycle, and results in low manufacturing speed.

Further, the higher the mold is heated, the improved the effect of the heat treatment becomes, but when the mold is heated to a high temperature, an oligomer is precipitated from the bottle and adheres to the mold, which not only ruins the appearance of the produced bottle but also reduces productivity since there is a need to wipe away the oligomer on the surface of the mold regularly. This lowers the manufacturing speed even further.

On the other hand, a polyester bottle having a handle body fixed on the bottle body is used for an easier handling of the bottle. One method to mount the handle body to the bottle body is to set a preform for molding the bottle body to a cavity of a mold for molding the bottle with a handle body being set thereto which has been molded in advance by an injection molding and the like, and by blowing air into said preform for blow molding, forming the bottle body and connecting the handle body to the handle mounting portion of the bottle body. The second method performs blow molding to said preform set to said cavity of the mold, forming a bottle body having a handle mounting portion, and then by forming a handle body by injection molding, matching and fixing the handle body to said handle mounting portion.

However, by applying a method of providing heat treatment by heating the mold in the above mentioned method, the wall surface of the handle mounting portion of the bottle body will not contact the highly heated mold because of the handle body mounted thereto, so the wall surface of the handle mounting portion will not be heat treated, and the handle mounting portion will not be provided with a sufficient heat resistance. Therefore, at the time of heat-filling, there was a problem that the handle mounting portion will shrink or deform, and the mounting strength of the handle will be reduced.

OBJECT AND SUMMARY OF THE INVENTION

The object of the present invention is to provide a polyester bottle with a handle having not only a good heat resistance but also a good appearance, and a method of manufacturing the same.

The polyester bottle with a handle of the present invention includes a polyester bottle body and a synthetic resin handle body mounted to said bottle body. Said bottle body comprises a neck portion, a shoulder portion continuous from said neck portion, a body portion continuous from said shoulder portion, a bottom portion continuous from said body portion and a handle mounting portion on the wall surface of said body portions formed by blowing air into a preform which is set to a cavity of a mold for biaxial stretch blow molding. Said handle body comprises a grip portion and a fixing portion continuous from said grip portion. Said handle body is mounted to said bottle body by connecting said fixing portion to said handle mounting portion. A heat treatment is performed to at least a handle connecting portion of said handle mounting portion by heated air being blown into said bottle body.

In the case where said handle body is molded separately in advance, the connection between the fixing portion of said handle body and said handle mounting portion is performed by enveloping said fixing portion set to the cavity of said mold by said handle mounting portion at the time of said blow molding. In the case where said handle body is formed by injection molding after the blow molding of said bottle body, the connection between said fixing portion of said handle body and said handle mounting portion is performed by enveloping said fixing portion formed by injection molding by said handle mounting portion formed by said blow molding. Said heat treatment is either performed either after or simultaneously with the blow molding of said bottle body.

The body portion of said bottle body of said polyester bottle with a handle includes at least a part including the handle mounting portion having an inner surface with an average refractive index of 1.590 or more, which is not less than 0.001 higher than the average refractive index of the outer surface.

By the structure disclosed above, a polyester bottle with a handle having a various shape which has high heat resistance, good appearance, low stretching rate, and a stable mechanical strength of the handle mounting portion, with improved productivity could be provided.

The first method of manufacturing the present polyester bottle with a handle, wherein a synthetic resin handle body is mounted to a polyester bottle body, comprises the step of setting said handle body molded in advance having a grip portion and a fixing portion continuous from said grip portion and a polyester preform to a cavity of a mold. Next, while forming said bottle body having a neck portion, a shoulder portion continuous from said neck portion, a body portion continuous from said shoulder portion, a bottom portion continuous from said body portion, and a handle mounting portion on the wall surface of said body portion, by a biaxial stretch blow molding of said preform, simultaneously envelope said fixing portion in said handle mounting portion for connection. Further, provide a heat treatment to at least a handle connecting portion of said handle mounting potion by blowing heated air into said bottle body having a higher temperature than the air used for said blow molding.

The second method of manufacturing is performed by setting said handle body molded in advance having a grip portion and a fixing portion continuous from said grip portion and a polyester preform to a cavity of a mold. Next, form said bottle body having a neck portion, a shoulder portion continuous from said neck portion, a body portion continuous from said shoulder portion, a bottom portion continuous from said body portion, and a handle mounting portion on the wall surface of said body portion by a biaxial stretch blow molding of said preform while blowing heated air into said preform for heat treatment, and envelope said fixing portion in said handle mounting portion for connection. Simultaneously, provide a heat treatment to at least a handle connecting portion of said handle mounting potion.

The third method of manufacturing comprises the steps of setting a polyester preform to a cavity of a mold, forming said bottle body having a neck portion, a shoulder portion continuous from said neck portion, a body portion continuous from said shoulder portion, a bottom portion continuous from said body portion, and a handle mounting portion on the wall surface of said body portion by a biaxial stretch blow molding of said preform. Next, mold said handle body comprising a grip portion and a fixing portion continuous from said grip portion by an mold for injection molding of a handle which is set to said cavity of said mold, while simultaneously connecting said fixing portion to said handle mounting portion for connecting said handle body to said bottle body. Further, provide a heat treatment to at least a handle connecting portion of said handle mounting potion by blowing heated air into said bottle body having a higher temperature than the air used for said blow molding.

The fourth method of manufacturing comprises the step of setting a polyester preform to a cavity of a mold, forming said bottle body having a neck portion, a shoulder portion continuous from said neck portion, a body portion continuous from said shoulder portion, a bottom portion continuous from said body portion, and a handle mounting portion on the wall surface of said body portion by a biaxial stretch blow molding of said preform while blowing heated air into said preform for heat treatment, and simultaneously providing heat treatment to a handle connecting portion of said handle mounting portion, and molding said handle body comprising a grip portion and a fixing portion continuous from said grip portion by a mold of an injection molding of a handle which is set to said cavity of said mold, while simultaneously connecting said fixing portion to said handle mounting portion to mount said handle body to said bottle body.

As above, the heat treatment to the wall surface of the handle mounting portion which will not contact the heated mold because of the fixing portion of the handle mounted thereto could be performed by the heated air being blown into the bottle body, thereby improving the heat resistance of the wall surface of the handle mounting portion, which prevents problems such as the handle body falling off from the bottle body.

Further, according to the second manufacturing method, the molding of the bottle body, the mounting of the handle body to the bottle body and the heat treatment to the wall surface of the handle mounting portion could be performed simultaneously, thereby improving productivity of the polyester bottle with a handle.

The thermoplastic resin used as the material of the present bottle body may preferably be a polyethylene terephthalate, a polyethylene naphthalate, or a mixture of the two. However, as a copolymer component, isophthalic acid, p-β-oxyethoxy benzoate, naphthalene 2,6-dicarboxylic acid, diphenoxyethan-4,4-dicarboxylic acid, 5-soldium sulhoisophthalic acid, adipic acid, sebacic acid, or the dicarboxylic acid component of these alkylester derivative and the like, propylene glycol, 1,4-butanediol, neopentyl glycol, 1,6-hexylene glycol, cyclohexane dimethanol, and copolyester and the like including a glycol component such as an ethylene oxide adduct of a bisphenol A, could be included thereto in the range where the characters of the present polyester bottle or the object of the present invention will not be affected, that is, in the range of under 10 mol %. Further, an additive such as stain of dyestuff, pigment and the like, ultraviolet absorber, antistatic agent, and so on could be added thereto.

Said handle body is formed by injection molding of a thermoplastic synthetic resin material of, for example, a thermoplastic polyester resin as of said bottle body, or polypropylene, or heat resistant poly-4-methyl-1-pentene, or the recycled material of these materials.

DETAILED DESCRIPTION OF THE PREFERRED EMBODIMENTS

The embodiment of the polyester bottle with a handle and the manufacturing method of the same according to the present invention will be explained in detail hereinafter based on the accompanied drawings.

Figure 1:
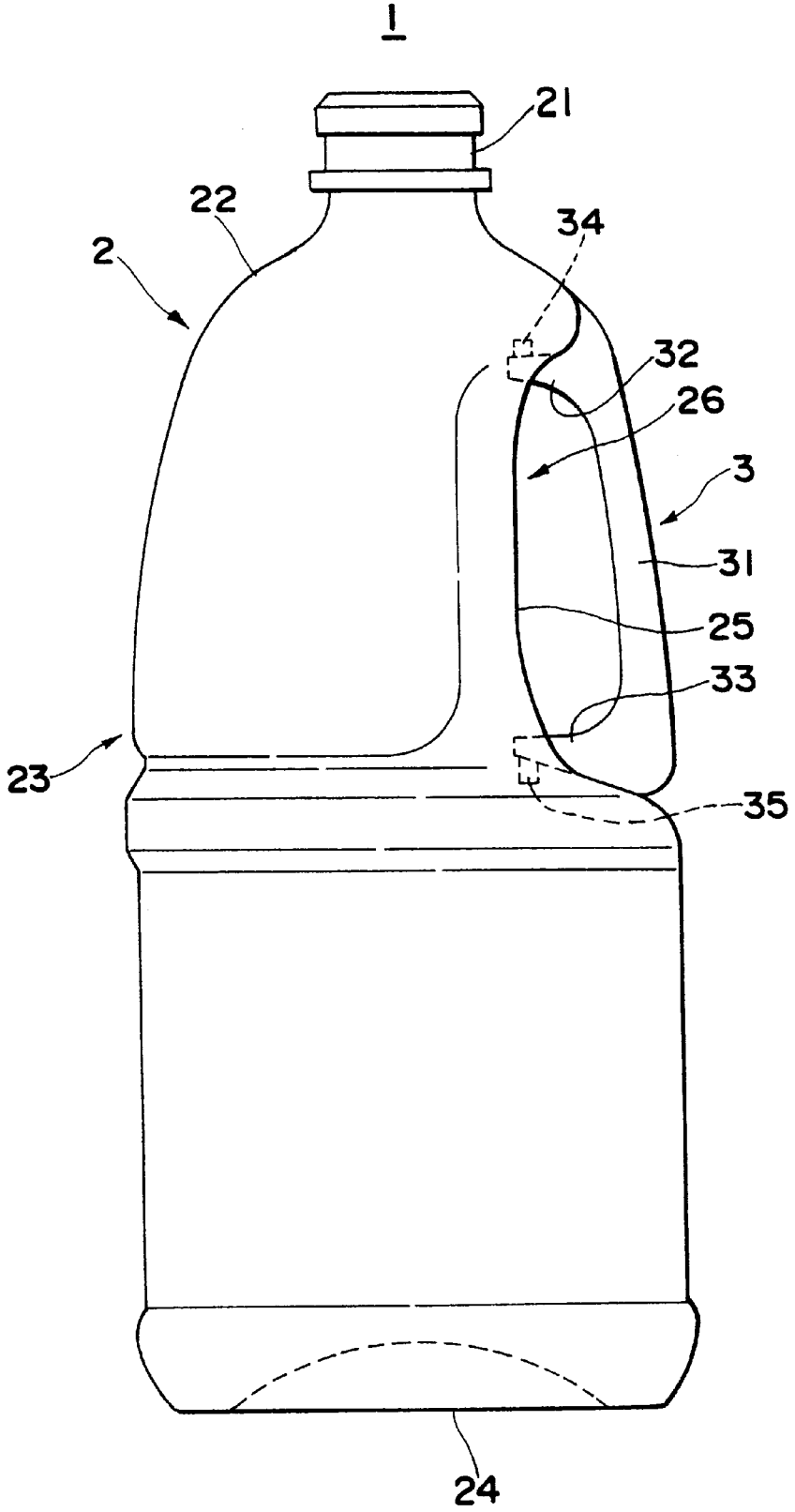
FIG. 1 is a front view showing one embodiment of the polyester bottle with a handle of the present invention.

As is shown in FIG. 1, the polyester bottle with a handle 1 includes a bottle body 2 made of polyester and a handle body 3 made of synthetic resin. Said bottle body 2 is formed by a biaxial stretch blow molding method which is performed by blowing a high-pressure gas (high-pressure air blow) into a preform (parison) inserted to a cavity of a mold, and said bottle body 2 comprises a neck portion 21, a shoulder portion 22 continuous from the neck portion 21, a body portion 23 continuous from the shoulder portion 22, and a bottom portion continuous from the body portion 23. On a wall surface 25 of a concave portion of said body portion 23 is formed a handle mounting portion 26.

Figure 2:
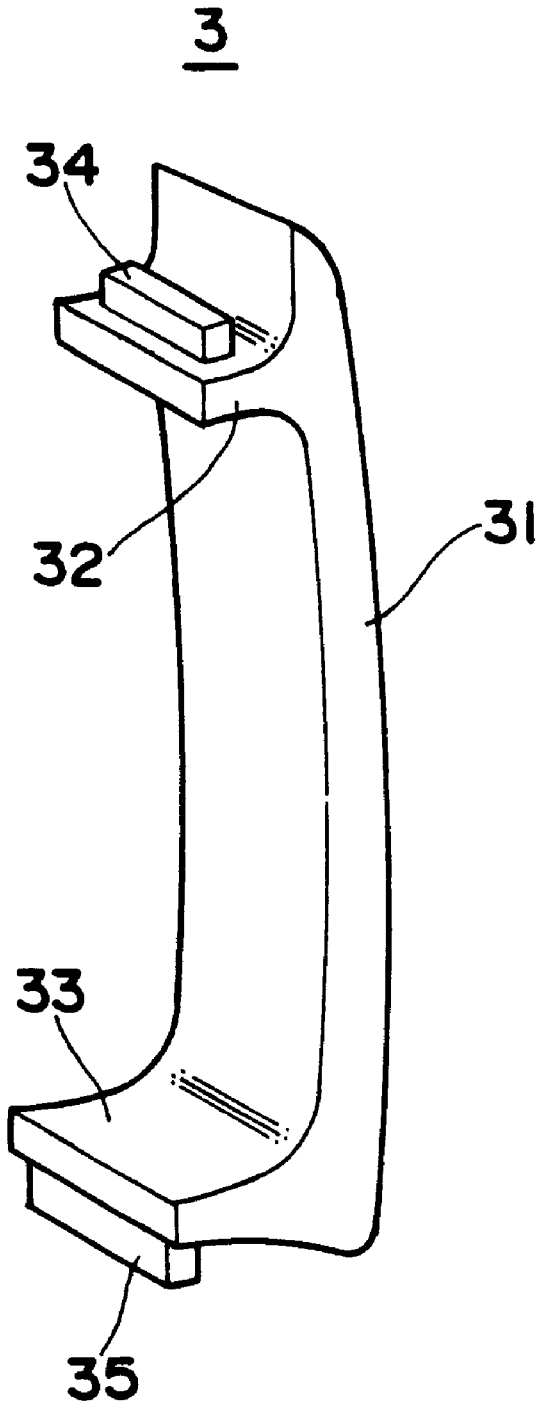
FIG. 2 is a schematic view of the handle body which has been previously molded.
Figure 3:
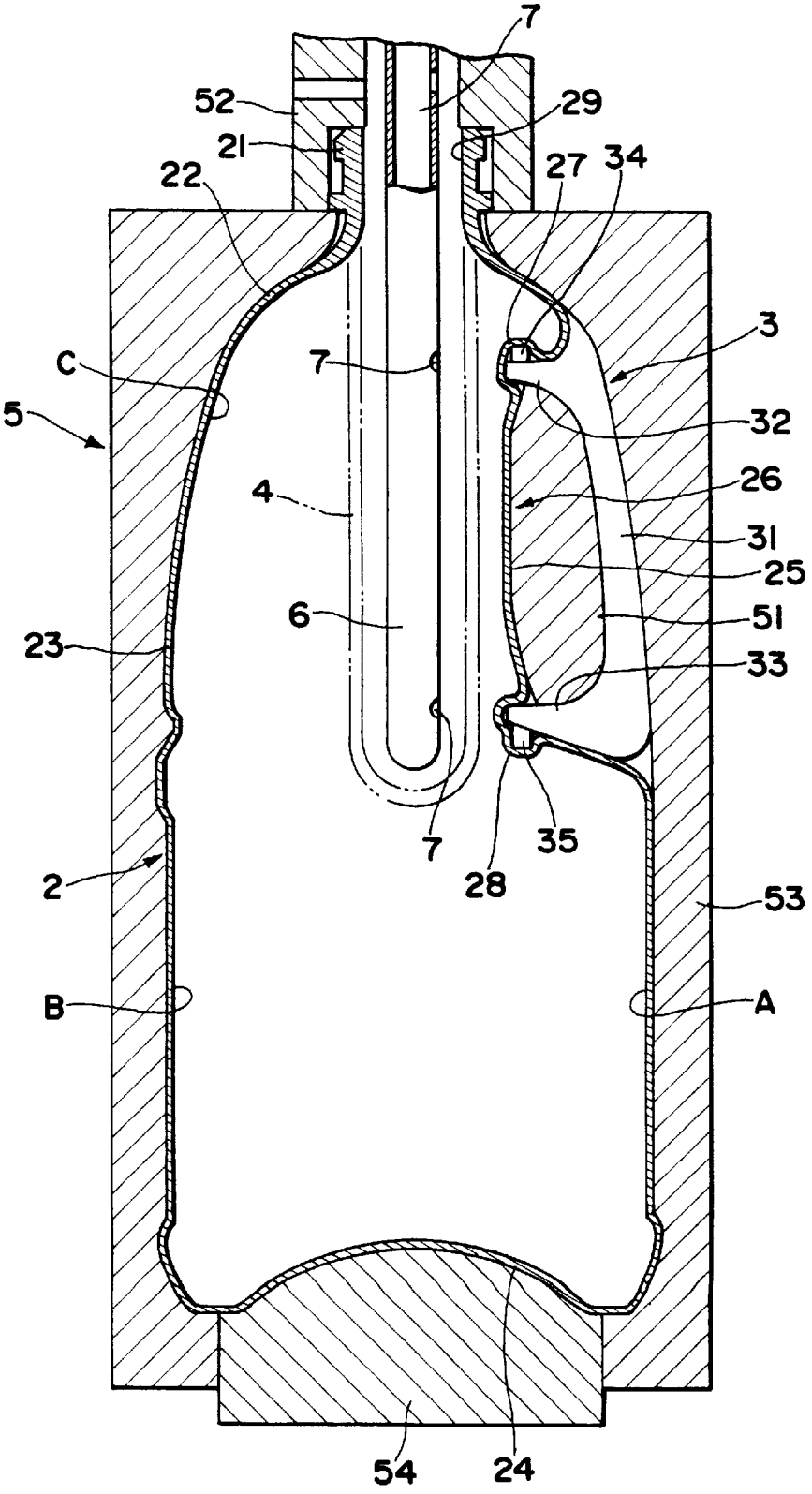
FIG. 3 is a cross-sectional view of the mold explaining the first manufacturing method of the polyester bottle with a handle of the present invention.

Said handle body 3 is molded in advance by a separate step, and as is shown in FIG. 2, it comprises a grip portion 31, and fixing portions 32, 33 protruding to the side direction from the upper and lower ends of said grip portion 31. Said fixing portion 32 is equipped with a convex 34 formed upward, and said fixing portion 33 is equipped with a convex 35 facing downward. Said handle body 3 is preset to the cavity of said mold as is shown in FIG. 3, and by blow molding, the convex 34 and 35 will be enveloped and connected by connecting portions 27 and 28 which are formed on the upper and lower portion of the handle mounting portion 26, which mounts said handle body 3 to said bottle body 2.

Said bottle body 2 is formed so that at least said handle mounting portion 26 is heat fixed (heat treated) by the heated air being blown into said bottle body 2. That is, at least said connecting portions 27 and 28 are provided with heat treatment by the heated air being blown into said bottle body 2. In detail, the degree of crystallinity is set to be 27% or more and 55% or less, preferably 30% or more and 50% or less. Further, the wall surface 25 between the connecting portions is also preferably provided with heat treatment, and further, the whole wall around the connecting portions 27, 28 and its proximate areas where the fixing portions 32, 33 of the handle mounting portion 26 contact is preferably provided with heat treatment. Further, at least the part of the body portion of the bottle body including said handle mounting portion 26 preferably has an average refractive index of the inner surface being 1.590 or more, and which is not less than 0.001 higher than average refractive index of the outer surface. This heat fixing could be performed either after the blow molding of the bottle body 2, or simultaneously.

Further, in the above embodiment, a handle body 3 which has separately been molded in advance was used. However, it could also be applied to the case where said handle body is formed by an injection molding after the blow molding of said bottle body. In this case, the connection of the fixing portions and the handle mounting portion is realized by enveloping said fixing portions being injection molded by said handle mounting portion being formed by blow molding.

Next, the first embodiment of the method of manufacturing said polyester bottle with a handle will be explained based on FIGS. 2 and 3.

First, by injection molding, a molded body called a preform (parison) 4 is manufactured which is non-crystal with a hollow cylindrical body having a bottom. Next, the preform 4 is heated to a stretchable temperature, and then, as is shown in FIG. 3, mounted to a predetermined position of the cavity on a mold 5 for blow molding. At the same time, a handle body 3 molded separately in advance (having a shape shown in FIG. 2) is also set to a predetermined position of the cavity of said mold 5. Next, the preform 4 is stretched to the axial direction by a stretching rod 6, and a high-pressure gas (air blow) is blown into the preform 4, which stretches the preform 4 in the peripheral direction, molding the bottle body 2 corresponding to the shape of the cavity of said mold 5, forming connecting portions 27 and 28 of the upper and lower portions of said handle mounting portion 26, and at the same time, protrusions 34 and 35 of said handle body 3 is enveloped and connected to said connecting portions 27 and 28, which fixes the handle body 3 to the bottle body 2.

Further, heated air which has a higher temperature than the air being used for the blow molding is blown into said bottle body 2 in order to provide heat treatment to said handle mounting portion 26. That is, heated air of 110° C. or more and 260° C. or less, preferably 120° C. or more and 240° C. or less is blown in by a blow-in time of 2 seconds or more and 30 seconds or less, preferably 3 seconds or more and 10 seconds or less, to the bottle body 2 from an opening cap portion 29 of the bottle body 2 by, for example, a nozzle 7 of a stretching rod 6, so that at least said connecting portions 27 and 28 will be provided with heat treatment by being heated from the inner surface, so that it has a degree of crystallinity of 27% or more and 55% or less, preferably 30% or more and 50% or less.

According to the method of blowing heated air into the body from the opening cap portion 29, heat treatment could be performed by a very short period of time. Further, the areas where heating from the outer surface is troublesome with the handle body being positioned in the way, such as the connecting portions 27 and 28 where the ends of the fixing portions 32 and 33 are connected, or the upper and lower portions of said wall surface 25 where the ends of fixing portions 32 and 33 are contacted, the heating from the inner surface is easy. Therefore, said method is advantageous in that the handle body 3 could be mounted to the bottle body 1 simultaneously as the stretch blow molding, and heat treatment could be performed in the same state.

The intermediate portion between the connecting portions 27 and 28 of said wall surface 25 does not contact the handle body 3, so it could be heated from the outer surface. For example, a concave portion mold 51 of the mold 5 could be heated to a temperature of 110° C. or more and 200° C. or less, preferably 120° C. or more and 180° C. or less, and the intermediate portion of said wall surface 25 which has been stretch blow molded could be provided with heat treatment by contacting the same to the concave portion mold 51.

Further, a body portion mold 53 of the mold 5 except for the opening cap portion mold 52 could be heated to a temperature of 110° C. or more and 200° C. or less, preferably 120° C. or more and 180° C. or less, and a bottom mold 54 to a temperature of 80° C. or more and 150° C. or less, preferably 100° C. or more and 120° C. or less, and then the bottle body 2 which has been molded by blow stretching could be contacted thereto, in order to perform a heat treatment to the bottle body 2 except for the connecting portions 27 and 28 of the wall surface 25 and the areas approximate thereto.

Further, an oil pipe or an electric heater not shown could be mounted to the concave portion mold 51, the body portion mold 53 and the bottom mold 54 enabling control of the temperature.

Further, the opening cap portion 29 of the bottle body 2 could be treated to improve the heat resistance by providing a heat crystallization process thereto when the shape and the thickness of the preform for molding the bottle body 2 is still left as it is and which is yet to be stretched, and the bottom portion could be improved of its heat resistance by forming a concave portion to create a raised bottom shape, and forming a radial rib from the center thereof, for example.

Next, a second embodiment of the method for manufacturing said polyester bottle with a handle is explained. FIGS. 2 and 3 used for said embodiment will be used for the present explanation.

A preform 4 heated to a stretchable temperature is mounted to a predetermined position of a cavity on a mold 5 for blow molding. At the same time, a handle body 3 separately molded in advance is also set to a predetermined position of the cavity of said mold 5. Next, the preform 4 is stretched to the axial direction by a stretching rod 6, and a heated air for heat treatment is blown into the preform 4, which stretches the preform 4 in the peripheral direction, molding the bottle body 2 corresponding to the shape of the cavity of said mold 5, forming connecting portions 27 and 28 of the upper and lower portions of said handle mounting portion 26, and at the same time, protrusions 34 and 35 of said handle body 3 is enveloped and connected to said connecting portions 27 and 28, which fixes the handle body 3 to the bottle body 2.

At this time, the temperature of said mold 5 should be in the range of 60 through 120° C., preferably in the range of 80 through 110° C., and the temperature of the heated air for said heat treatment should be in the range of 150 through 500° C., preferably in the range between 180 and 400° C.

When performing the blow molding and the heat treatment at the same time in the mold 5, it is preferable to heat the temperature of the mold to the highest heat possible from the point of view to provide heat resistance, but from the point of view of productivity or the removing of the bottle, the temperature of the mold should be set to a lower heat. Therefore, the range of temperature of the mold would differ by the kind of polyester used, the molecular orientation and the level of heat treatment, but it should be set to a highest temperature possible in the range that the formed bottle could be taken out without deformation, practically without cooling the mold.

On the other hand, the temperature of the heated air being blown into the preform 4 should be high for an advantageous heat treatment, but could be set according to the characteristics of the polyester material being used, the temperature of said mold, the cost needed to heat the air, and the like. Further, the amount of heated air being introduced, and the time of introduction could be set in the range enabling preferable heat treatment, and it could be set appropriately according to the temperature of the air and the mold.

That is, the heat treatment of the bottle body 2 is performed by setting the temperature of the heated air to a range of 150 through 500° C., preferably between 180 and 400° C., and keeping the temperature of the mold in a range of 60 through 120° C., preferably between 80 and 100° C. where the molded bottle body 2 could be removed without practically cooling the same. This enables simultaneous performance of the stretch blow molding and the heat treatment. Further, the bottle could be taken out from the mold 5 almost without the need of setting a cooling time in the molding cycle, which leads to a shortened molding cycle, thereby improving manufacturing speed.

Further, by setting the temperature of the mold to a comparably low temperature which enables the removal of the bottle from the mold practically without cooling, no oligomer will be precipitated from the bottle. Therefore, the oligomer will no longer be adhered to the mold, ruining the appearance of the bottle as was the case in the prior art, and at the same time, the productivity will largely be improved because there is no need to wipe off the oligomer being adhered to the mold surface.

Further, in the bottle with a handle, by performing the heat treatment from the interior of the bottle body 2, a sufficient heat treatment of the connecting portions 27 and 28 of the handle mounting portion 26 could be performed which was impossible in the heat treatment performed by a heated mold, so a bottle with a handle having a good heat resistance could be gained.

Further, the term "practically without cooling" includes a cooling in the level for example of exchanging the heated air inside the interior of the bottle to the atmosphere when removing the bottle from the mold.

According to such biaxial stretch blow molding of the polyester bottle, a polyester bottle having an advantageous heat resistance and appearance, with a stable strength of the handle fixing portion having low stretching rate could be manufactured efficiently.

The polyester bottle of the present embodiment is transparent at least except the neck portion 21 and the bottom portion 24 of the bottle body 2, with a degree of crystallinity of 27% or more. As such, by forming a bottle with the shoulder portion 22 and the body portion 23 being transparent, and with a degree of crystallinity of 27% or more, a polyester bottle which not only has good heat resistance but also has good appearance could be gained.

Further, by forming at least a part of the body portion 23 not including the neck portion 21, the area from the neck portion 21 to the shoulder portion 22, and the bottom portion 24, to have an average refractive index of 1.590 or more at its inner surface which is not less than 0.001 higher than the average refractive index of the outer surface, a polyester bottle as was described above which not only has good heat resistance but also has good appearance could be gained.

Figure 4:
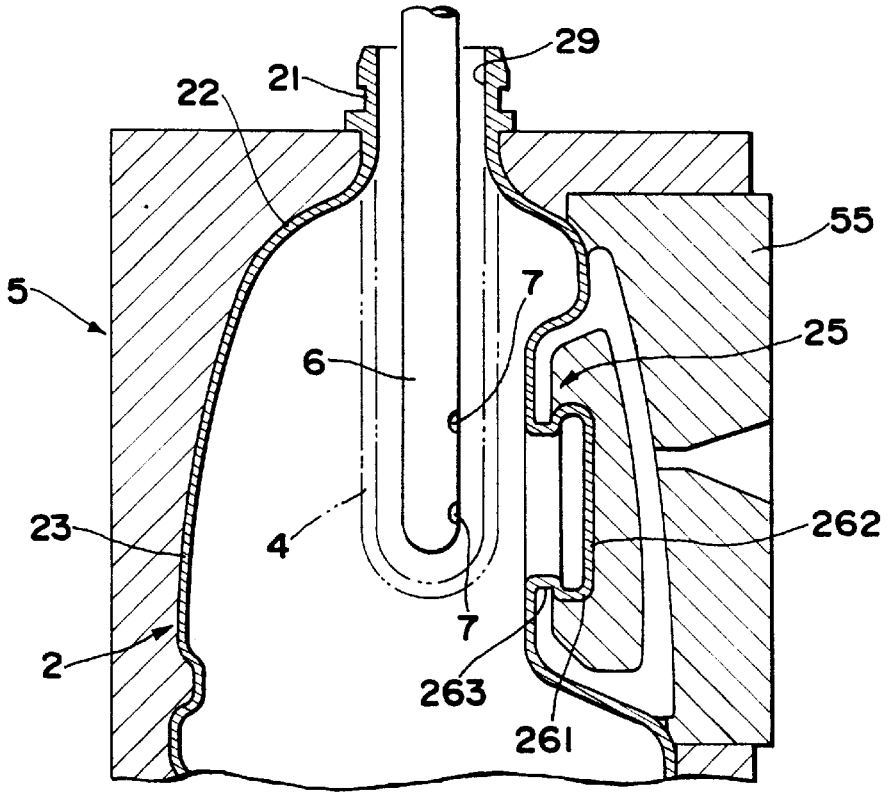
FIG. 4 is a cross-sectional view of the main portion of the mold explaining the second manufacturing method of the polyester bottle with a handle of the present invention.
Figure 5:
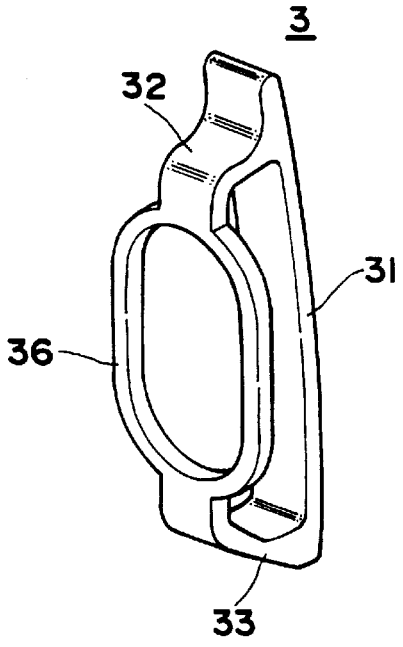
FIG. 5 is a schematic view of the handle body being manufactured by the second manufacturing method.

Next, the third embodiment of manufacturing the polyester bottle with a handle will be explained based on FIGS. 4 and 5.

First, a preform 4 for molding the bottle body mounted to a predetermined position of the cavity on a mold 5 for blow molding is biaxially blow stretched to mold a bottle body 2 corresponding to the shape of the cavity of the mold 5. At the same time, a handle mounting portion 26 is molded in the body portion 23, forming a protrusion 262 having a flange 261, and further forming a circular cavity 263 between the wall surface 25 of the concave portion on the body portion 23 and the flange 261.

Next, a mold 55 for injection molding of the handle is set to the cavity portion of the mold 5 which corresponds to the handle mounting portion 26, and a handle body 3 is molded by injection molding. The handle body 3 formed by said handle injection molding mold 55 comprises a grip portion 31, fixing portions 32 and 33 protruding sideways from the upper and lower ends of said grip portion 31, and a fixing ring 36 being formed on the ends of said fixing portion 32 and 33, as is shown in FIG. 5. Therefore, when the grip portion 31, fixing portions 32 and 33, and the fixing ring 36 are formed by injection molding, said fixing ring 36 fits to the circular cavity 263, and mounds the handle body 3 to the bottle body 2. At this time, the flange 261 could be expanded by blow molding to strengthen the connection, if necessary.

Further, a heated air having a heat higher than the heat of the air being used for blow molding is blown into said bottle body 2 to provide heat treatment to at least the handle mounting portion 26. Further, the temperature of the heated air, the blow-in time, the degree of crystallinity and the like are the same as the manufacturing method of the first embodiment.

Next, the fourth embodiment of the method of manufacturing the polyester bottle with a handle will be explained. Further, for the present explanation, FIGS. 4 and 5 both used in explaining the previous embodiment will be used again. This embodiment applies the third embodiment to the second embodiment.

That is, when biaxially blow stretching the preform 4 for molding the bottle body mounted to the predetermined position of the cavity of the mold 5 for blow molding, a heated air for heat treatment is blown into the preform, in order to provide heat treatment to at least the flange 261 and the protrusion 262 of the handle mounting portion 26 of the bottle body 2. Next, the fixing ring 36 of the handle body 3 having been molded by injection molding is fit to the circular cavity 263, in order to mount the handle body 3 to the bottle body 2.

EXAMPLE 1

After injection molding a polypropylene resin to mold the separate handle body 3 as is shown in FIG. 2, the handle 3 is set inside the mold 4 as shown in FIG. 3 for blow molding, and a parison 6 for molding a bottle body made of polyethylene terephthalate resin with a crystallized opening cap portion 29 is blow molded, forming the bottle body 2, and at the same time, the convex 34, 35 of the handle body 3 is mounted inside the connecting portion 27, 28 of the handle mounting portion 26 of the bottle body 2.

The temperature of the mold 5 except for the opening cap mold 52 and the bottom mold is set to 60° C. and 150° C., the bottom mold is set to 100° C., and the maintaining time inside the mold for blow molding is set to 3 seconds and 100 seconds.

Following the mold of the bottle body 2, either by removing without heat treatment, or by inserting a nozzle 7 from the opening cap portion 29 as shown in FIG. 2 to blow in heated and pressurized air of 120° C. and 180° C. with 20 kg/cm$^2$ for one second, three seconds and five seconds, heat treatment is performed to the connecting portions 27 and 28 where the convex 34 and 35 of the handle body 3 is mounted, and the wall surface 25 between the connecting portions 27 and 28, thereby gaining a 1800 ml polyester bottle with a handle.

Regarding the polyester bottle with a handle gained by the above method, the bottles were dropped by groups of ten from a height between 110 cm and 220 cm right after filling the bottle with a hot water of 87° C. and capping the same. By this experiment, the number of bottles whose handle body 3 were taken apart was counted, and further, by observing the appearance of the bottles by human eye, the bottle where no deformation nor slant could be recognized were evaluated as "good", those where deformation or slant could be barely recognized were evaluated as "fair", those with marked deformation or slant were evaluated as "poor", which are shown in Table 1, with a result of the measurement of the capacity reduction rate from the capacity of the bottle before filling the hot water included thereto.

Further, regarding these polyester bottles with a handle, the degree of crystallinity of the upper connecting portion 27 was measured as the connecting portion degree of crystallinity, further measuring the crystallization of the three areas A, B and C of the bottle body 2 (shown in FIG. 3) and calculating the average value as the bottle body degree of crystallinity, which are shown in Table 1.

The degree of crystallinity is the degree of crystallinity calculated by a density method, or in detail, measuring the density by a density gradient pipe, and calculating the degree of crystallinity X (%) by the next equation.

$$X=(d-da)/(dc-da)\cdot 100(\%)$$

| | |
|---|---|
| provided | d is the measured density at 25° C.(g/cm$^3$)<br>da = 1.335 g/cm$^3$<br>(density of complete amorphous polyester)<br>dc = 1.455 g/cm$^3$<br>(density of complete crystalline polyester) |

TABLE 1

| Experiment No | 1 | 2 | 3 | 4 | 5 | 6 |
|---|---|---|---|---|---|---|
| blow molding mold temperature excluding mouth and bottom mold | 60° C. | 60° C. | 60° C. | 150° C. | 150° C. | 150° C. |
| bottom mold temperature | 100° C. | 100° C. | 100° C. | 100° C. | 100° C. | 100° C. |
| maintaining time inside mold | 3 sec | 3 sec | 3 sec | 3 sec | 3 sec | 100 sec |
| air temperature | — | 120° C. | 180° C. | 180° C. | 180° C. | — |
| air blow-in time | — | 1 sec | 3 sec | 3 sec | 5 sec | — |
| connecting portion degree of crystallinity | 5% | 25% | 30% | 30% | 35% | 30% |
| bottle body degree of crystallinity | 20% | 25% | 25% | 30% | 35% | 30% |
| drop test: number of bottles fallen apart — 100 cm | 10/10 | 1/10 | 0/10 | 0/10 | 0/10 | 0/10 |
| 140 cm | 10/10 | 4/10 | 0/10 | 0/10 | 0/10 | 0/10 |
| 180 cm | 10/10 | 7/10 | 0/10 | 0/10 | 0/10 | 0/10 |
| 220 cm | 10/10 | 6/10 | 1/10 | 1/10 | 0/10 | 1/10 |
| bottle appearance after filling with 87° C. water | poor | poor | fair | good | good | good |
| capacity reduction rate after filling with 87° C. water | 10.0% | 7.2% | 3.5% | 0.2% | 0.2% | 0.2% |

As is clear from Table 1, in a polyester bottle with a handle having the convex 34 and 35 of the handle body 3 being connected to the connecting portions 27 and 28 of the handle mounting portion 26 for mounting the handle body 3 to the bottle body 2, at least the bottles of experiment 1 performing no heat treatment to said connecting portions 27 and 28 had their handles taken off by the drop from a height of 100 cm (ten out of ten), so it was inferior in its mounting strength.

Compared to this, the experiment numbers 2 through 6 with the connecting portions 27, 28 being heat treated, the handles taken off by the vertical drop was only six through zero out of ten bottles by the drop from a height of 220 cm, which shows a certain effect. Especially the bottles of experiment numbers 3 through 6 with the degree of crystallinity of the mounting portion 32, 33 of the handle 3 being 30% or more showed advantageous effects with only one to zero out of ten bottles having their handle taken off by a drop from a height of 220 cm. Even further, the bottles of experiment numbers 4 through 6 with the degree of crystallinity of the wall surface of the bottle body 2 being 30% or more with the mold temperature being up to 150° C. not only was effective in preventing the falling of the handle but also effective in preventing the appearance from changing by heat shrinking, and the reduction of capacity was held down to 1% or less.

EXAMPLE 2

The example regarding the second embodiment will be explained using the example of the embodiment and a comparison example.

The polyethylene terephthalate having an IV (intrinsic viscosity) of 0.76 is injection molded, and a preform with a thickness of 3.8 mm and a weight of 60 g with the neck portion being crystallized was formed. This preform was preheated to a temperature of 110° C., then mounted with the handle body 3 to the predetermined position of the cavity of the mold 5 for blow molding, and molded a polyester bottle with a handle by biaxially blow stretching having a capacity of 1.5 litters by the stretching rod 6 and air blow. Next, blown air is circulated for four seconds inside the bottle body 2, and then after exchanging the heated air inside the bottle body 2 by blowing atmosphere thereto, the mold was opened for removal of the bottle.

As was shown in Table 1, six kinds of bottles were manufactured by changing the temperature of the mold and the temperature of the blown air. For each bottle, the degree of crystallinity of the body portion 23, and the refractive index of the both inner and outer surfaces were measured, and the heat resistance of the bottle, the fixing state of the handle and the appearances were determined.

Further, the IV of the material resin was gained by the next experiment. First, the 400 mg sample was dissolved by agitating for 20 minutes to a 40 ml phenol-tetrachloroethane mixture solvent (weight ratio 1:1) under 120° C. Then, the viscosity of the gained solution was measured by Ubbelohde viscometer inside a 30° C. isothermal pool, and based on the following equation, calculated the IV.

| | |
|---|---|
| Relative viscosity | $\eta_{rel} = t/t_0$<br>t: drop time of solvent [sec]<br>$t_0$: drop time of solvent [sec] |
| Specific viscosity | $\eta_{sp} = \eta_{rel} - 1$ |
| IV | $\eta = \{-1 + (1 + 4 \cdot k' \cdot \eta_{sp})^{1/2}\}/(2 \cdot k' \cdot c)$<br>k':0.33 (Huggins coefficient)<br>c:1 (solution concentration) |

The degree of crystallinity was gained by using the sample cut out from the center of the body portion 23 of the bottle body 2. First, an n-heptane-tetrachloromethane system density gradient pipe was formed, and the density of the sample under the condition of 20° C. was calculated. Based on the gained density, the degree of crystallinity was calculated according to the following equation.

| | |
|---|---|
| Degree of crystallinity Xc = | $\{(\rho-\rho_a)/(\rho_c - \rho_a)\} \times 100[\%]$<br>$\rho$: measured density [g/cm$^3$]<br>$\rho_a$: amorphous density [g/cm$^3$]<br>$\rho_c$: crystalline density [g/cm$^3$] |

The average refractive index was gained by cutting out a sample from the center portion of the body portion of the bottle, and taking the refractive index from three directions (axial direction: $n_{AD}$, peripheral direction: $n_{HD}$, thickness direction: $n_{ThD}$)for both the outer surface and the inner surface of the bottle body by an Abbe refractometer, and the average value of these three refractive index was set as the average refracture (outer surface: $n_0$, inner surface: $n_i$).

The heat resistance was determined by filling hot water of 85° C. to each of the gained bottle, and the bottles where no deformation was recognized after cooling in water was determined "good", those where deformation could be recognized was determined "poor". At the same time, the fixed state of the handles were determined. Those maintaining a firm fixed state were determined "good", those having even small problems were determined "poor". Further, the outer appearance was determined by human eye to a bottle formed after molding 500 bottles continuously, and those having good surface glare were determined "good", and those with ruined surface glare were determined "poor". The results are shown in Table 2.

TABLE 2

| Experiment no. | 7 | 8 | 9 | 10 | 11 | 12 |
|---|---|---|---|---|---|---|
| mold temperature [° C.] | 70 | 70 | 70 | 100 | 100 | 125 |
| blow air temperature [° C.] | 30 | 180 | 30 | 180 | 30 | 180 |
| degree of drystal-linity [%] | 21 | 27 | 25 | 34 | 31 | 36 |
| average refractive index of outer surface: $n_0$ | 1.5842 | 1.5884 | 1.5911 | 1.5910 | 1.5940 | 1.5950 |
| average refractive index of inner surface: $n_i$ | 1.5849 | 1.5929 | 1.5898 | 1.5920 | 1.5918 | 1.5927 |
| $n_i - n_0$ | 0.0007 | 0.0045 | −0.0021 | 0.0010 | −0.0022 | −0.0023 |
| heat resistance | poor | good | poor | good | good | good |
| state of handle | poor | good | poor | good | good | good |
| appearance | good | good | good | good | poor | poor |

We claim:

1. A polyester bottle with a handle including a polyester bottle body and a synthetic resin handle body mounted to said bottle body, said bottle body comprising a neck portion, a shoulder portion continuous from said neck portion, a body portion continuous from said shoulder portion, a bottom portion continuous from said body portion and a handle mounting portion on the wall surface of said body portion, formed by blowing air into a preform which is set to a cavity of a mold for biaxial stretch blow molding, said handle body comprising a grip portion and a fixing portion continuous from said grip portion, said handle body being mounted to said bottle body by connecting said fixing portion to said handle mounting portion, wherein a heat treatment is performed to at least a handle connecting portion of said handle mounting portion by heated air being blown into said bottle body so that said at least a handle connecting portion has a degree of crystallinity of 27% or more and 55% or less.

2. The polyester bottle with a handle of claim 1, wherein said handle body is molded separately in advance, and the connection between the fixing portion of said handle body and said handle mounting portion is performed by enveloping said fixing portion set to the cavity of said mold by said handle mounting portion at the time of said blow molding.

3. The polyester bottle with a handle of claim 1, wherein the connection between said fixing portion of said handle body and said handle mounting portion is performed by enveloping said fixing portion formed by an injection molding carried out after the blow molding by said handle mounting portion formed by said blow molding.

4. The polyester bottle with a handle of claim 1, wherein said heat treatment is performed after the blow molding of said bottle body.

5. The polyester bottle with a handle of claim 1, wherein said heat treatment is performed simultaneously with the blow molding of said bottle body.

6. The polyester bottle with a handle of claim 1, wherein at least a part of the body portion of said bottle body including said handle mounting portion has an inner surface with an average refractive index of 1.590 or more, which is not less than 0.001 higher than the average refractive index of the outer surface.

7. The polyester bottle with a handle of claim 1 wherein the degree of crystallinity is 30% or more and 50% or less.

* * * * *